United States Patent [19]

Campbell

[11] 4,287,739

[45] Sep. 8, 1981

[54] METHOD FOR PRODUCING A HELICALLY WOUND PIPE HAVING A PREDETERMINED DIAMETER

[75] Inventor: George L. Campbell, Scottsdale, Ariz.

[73] Assignee: Syracuse Tank & Manufacturing, Phoenix, Ariz.

[21] Appl. No.: 23,585

[22] Filed: Mar. 26, 1979

[51] Int. Cl.[3] ..... B21C 51/00; B21C 37/12

[52] U.S. Cl. ..... 72/34; 29/407; 72/50; 228/56.5

[58] Field of Search ..... 29/33 D, 407, 429, 509; 72/34, 49, 50, 135; 138/154; 228/17.7, 56.6, 145

[56] References Cited

U.S. PATENT DOCUMENTS

| | | | |
|---|---|---|---|
| 2,515,365 | 7/1950 | Zublin | 138/154 X |
| 3,140,534 | 7/1964 | Messina | 29/407 |
| 3,417,587 | 12/1968 | Campbell | 72/50 |
| 3,739,459 | 6/1973 | Otani | 228/145 |

FOREIGN PATENT DOCUMENTS

| | | | |
|---|---|---|---|
| 258520 | 4/1928 | Italy | 138/154 |

*Primary Examiner*—Ervin M. Combs

*Attorney, Agent, or Firm*—Cahill, Sutton & Thomas

[57] ABSTRACT

A method for forming helically wound pipe from an elongated sheet of material having a longitudinal axis wherein markings are provided perpendicular to said longitudinal axis adjacent the edges of the elongated sheet of material at predetermined spaced intervals. The elongated sheet is fed in a direction parallel to its axis and wound helically to form a helically wound pipe having adjoining revolutions while maintaining the distance, parallel to said longitudinal axis, between successive indicia adjacent the edge of one revolution and the indicia adjacent the edge of the adjoining revolution constant.

6 Claims, 9 Drawing Figures

METHOD FOR PRODUCING A HELICALLY WOUND PIPE HAVING A PREDETERMINED DIAMETER

The present invention pertains to methods for producing helical pipe, and more particularly, to a method for maintaining the diameter of such pipe constant during the production thereof.

When forming a helically wound pipe or tube from a continuous strip or sheet of material, one of the most significant problems is the control of diameter of the resulting pipe. An improved technique, as well as some background materials, are discussed in U.S. Pat. No. 3,417,587. In that patent, a machine is described for corrugating or spirally winding a pipe while providing an adjustment for determining ultimate pipe diameter. One of the principle difficulties in controlling pipe diameter is the requirement that changes in diameter be detected as promptly as possible to avoid a situation wherein the diameter begins to grow or shrink after the machine has once been set. Numerous situations can arise that will cause such variations in pipe diameter; however, by detecting the trend of the change in diameter early, the remedial process and correction can be made much easier.

Typically, a helically wound corrugated metal pipe is manufactured from a coil of metal that is first unwound and then fed into a machine that corrugates and helically winds the pipe such as described in the above identified patent. When manufacturing the pipe in small sizes, once the leading opening has been sized to the desired diameter, it becomes difficult to continuously measure or to subsequently measure the diameter because of the machinery, such as a forming mandrel, that typically extends into the pipe at its forming end. Thus, the accuracy of such measurements are imperfect at best, and the machinery must be stopped so that such measurements may be carefully made. When large diameter pipe is being manufactured, it is necessary to stop the operation and for a workman to crawl or stand inside the pipe to measure the diameter at several diametric points. This latter procedure is necessary because in many cases the pipe may not be perfectly round but may actually be oval in shape. Under such circumstances, it is necessary to average the readings and to accept the average as the diameter of the pipe. It is difficult, if not impossible, in most instances to be sure of uniform diameter of such large pipe because of the crude means required for taking successive measurements.

If accurate diameters are known on a continuing basis, substantial time and material would be saved by adjusting the machinery to provide the desired diameter and compensate for deviations from such desired diameter. Such technique would save the down time of the equipment now required to make such measurements, and will also save the loss of valuable helically wound pipe that must be cut off and discarded because it is either too large or too small.

It is therefore an object of the present invention to provide a method for forming a helically wound pipe having a predetermined diameter wherein said diameter may be continuously monitored.

It is another object of the present invention to provide a method of forming a helically wound pipe having a predetermined diameter wherein corrections may be made during the winding of the pipe to insure conformance to a predetermined diameter.

It is still another object of the present invention to provide a method of forming a helically wound pipe having a predetermined diameter wherein an immediate indicia is made available to the operator of the winding machine upon any deviation from the predetermined diameter.

These and other objects of the present invention will become apparent to those skilled in the art as the description thereof proceeds.

Briefly, the present invention is described in relation to its application to the manufacture of helically wound corrugated metal pipe of the type typically used in the construction of highways and similar projects. The pipe is wound from a continuous strip of metal that has been formed into a roll for purposes of shipment. The roll is mounted on a machine and the metal is unwound and straightened; the resulting metal strip is fed longitudinally of its axis into the helically winding machine which simultaneously corrugates the metal and forms it into a pipe having ajoining revolutions and having a predetermined desired diameter. The adjoining revolutions are connected such as by interlocking adjacent edges of adjoining revolutions as described in the above identified patent. The strip of metal is provided with indicia such as lines extending perpendicular to the longitudinal axis of the strip of material and positioned adjacent the opposite edges of the strip. The lines may extend entirely across the strip or may only be positioned adjacent the opposite edges. In either event, the indicia may be placed only on one surface of the strip or on both surfaces for reasons to be described more fully hereinafter.

As the strip is fed longitudinally thereof into the machine and formed into helical revolutions, the indicia on adjacent edges of adjacent or adjoining revolutions oppose one another. If the diameter of the pipe remains the same as it is being produced, the relative position of the opposing indicia will remain the same; any increase or decrease in the diameter of the pipe being produced will result in a change in the distance between the indicia on adjacent edges of adjoining revolutions.

The present invention may more readily be described by reference to the accompanying drawings, in which.

Figure 1:
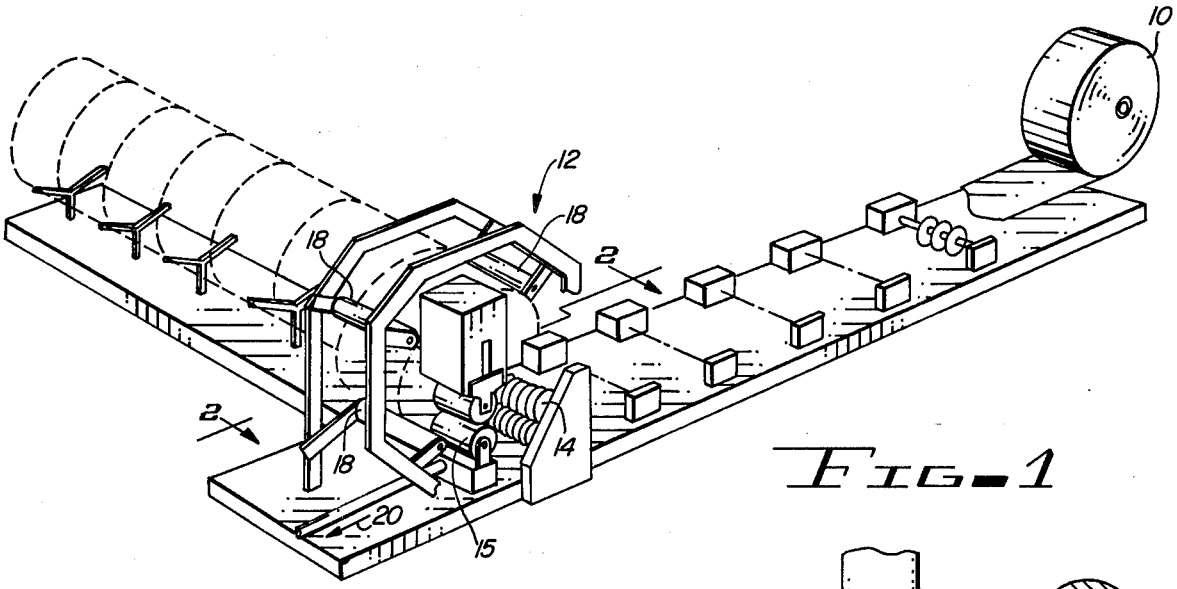
FIG. 1 is a perspective view, in somewhat schematic form, of a typical helically wound pipe winding machine useful in describing the method of the present invention.
Figure 3:
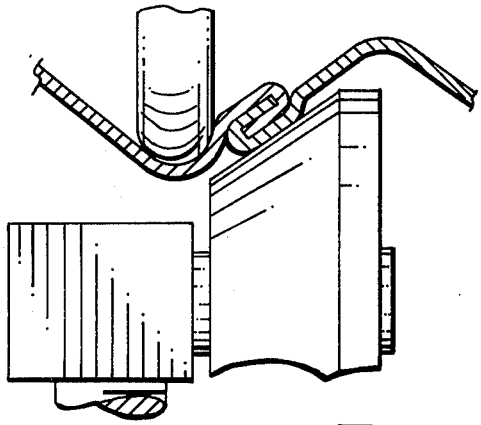
FIGS. 3 and 4 show respective details of a corrugated helically wound pipe machine useful in describing the background of the method of the present invention.
Figure 2:
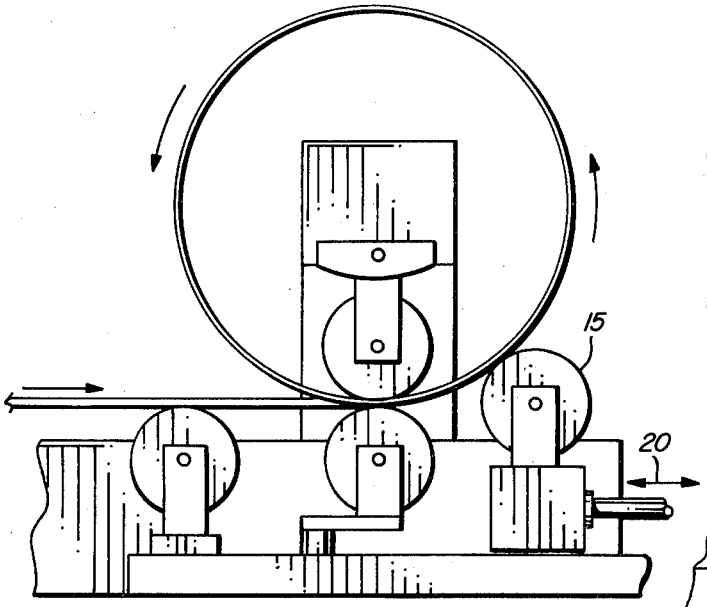
FIG. 2 is a side elevational view of a strip of metal being formed into a helically wound pipe showing a typical means for adjusting the diameter of the resulting pipe.
Figure 4:
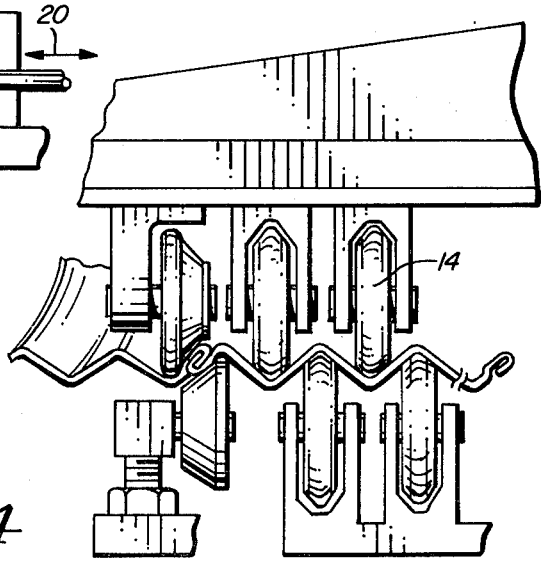

Referring now to the drawings, and particularly to FIG. 1, a typical helically wound pipe making machine is shown wherein a roll of sheet steel 10 is appropriately mounted to feed the steel therefrom in a flat strip into a rolling mill indicated generally at 12. The flat strip is corrugated by a series of interlocking rollers 14, the details of which are shown more clearly in FIG. 4 and the corrugated sheet passes through forming rollers and is subsequently bent to an appropriate curvature by a buttress roll 15 such as that shown in FIG. 2. As the strip of steel passes from the buttress roll, it is guided by a plurality of support rollers, such as those shown at 18, back upon itself so that the edge thereof can be locked to the adjoining revolution in any convenient manner such as that shown in FIGS. 3 and 4. The diameter of the resulting pipe may be controlled in a variety of ways; however, the primary diameter control is the positioning of the buttress roll 15 by moving the roll toward or away from the oncoming strip as it is being formed. The motion of the buttress roll, as indicated by arrows 20, will increase or decrease the curvature imparted to the metal strip as it contacts the buttress roll. Theoretically, once the diameter of the pipe has been properly set, the machine should be able to produce pipe of the predetermined diameter; however, variations in various operating parameters, as well as variations in the properties of the metal, will frequently result in undesirable changes in the diameter. For example, variations in the hardness of the steel will generally cause a variation of the curvature imparted by the buttress roll and therefore cause a variation in the diameter of the resulting pipe.

The formation of helically wound pipe by a technique such as that generally described above, requires constant attention to the diameter of the pipe being produced and is also generally presented with the problems discussed above. The method of the present invention contemplates the incorporation of indicia, such as painted lines or stripes, placed adjacent the opposite edges of the strip of steel. The indicia may be placed on the steel when it is originally fabricated and wound onto the roll, or it may be placed on the strip as it is fed into the rolling mill. The indicia can be placed on either or both sides of the strip and, if desired, can extend across the entire width of the strip or simply extend a short distance toward the center of the strip from the respective edge.

Figure 5:
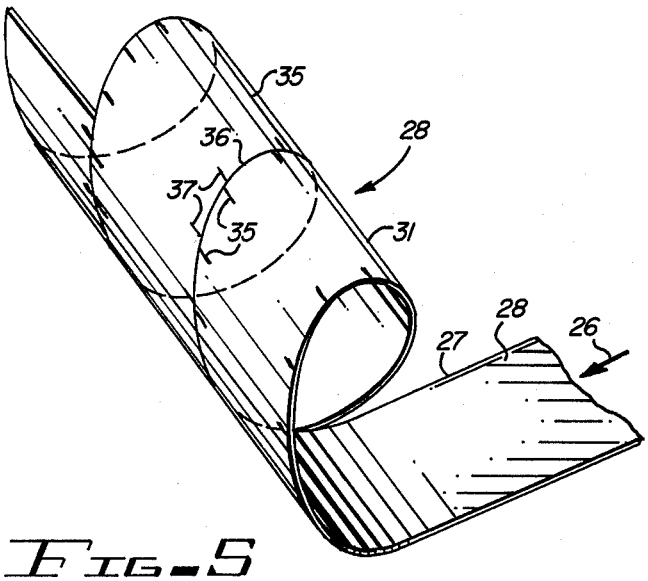
FIG. 5 is a schematic illustration of a helically wound pipe having indicia placed on the exterior surface of the pipe in accordance with the method of the present invention.

As shown in FIG. 5, the metal strip 25 is being fed longitudinally of its axis, as indicated by arrow 26, to be joined at its edge 27 and form a continuation of the pipe 28. As the strip is wound, and forms successive revolutions such as those at 30 and 31, the indicia such as that shown at 35 adjacent the edge 27, is clearly visible on the outside of the pipe. At the junction between the adjoining revolutions 30 and 31, the seam 36 is clearly visible and the indicia 35 can be seen opposing similar indicia 37 on the revolution 30.

Figure 6:
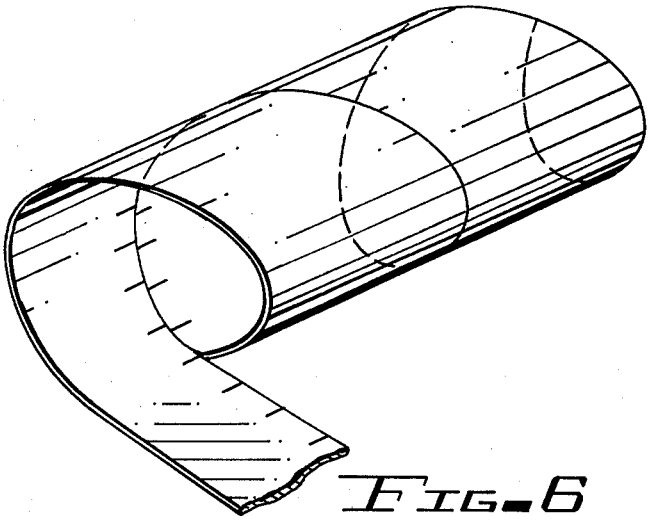
FIG. 6 is a schematic representation of a helically wound pipe having indicia placed on the inside of the pipe in accordance with the teachings of the present invention.
Figure 7:
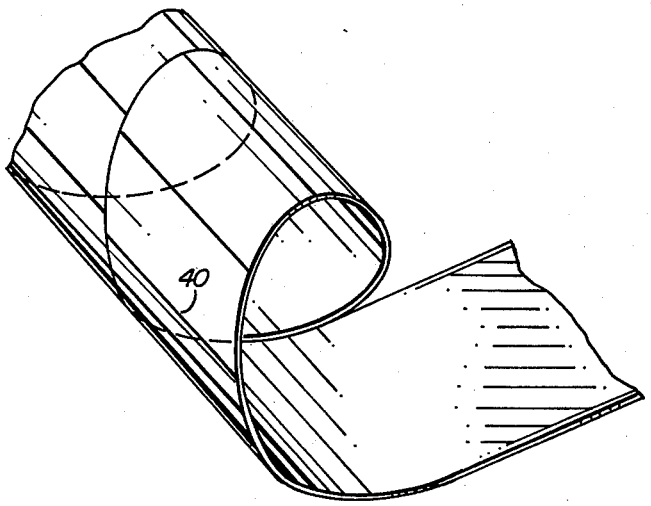
FIG. 7 is a schematic representation of a helically wound pipe showing indicia placed on the exterior of the pipe and extending the entire width of the strip of material of which the pipe is made.

The indicia, such as those shown at 35 and 37 in FIG. 5, may similarly be placed on the inside of the pipe such as that shown in FIG. 6; further, if desired, the indicia may take the form of lines extending the entire width of the strip such as shown at 40 in FIG. 7.

As the helical pipe is formed, the seams between adjacent revolutions form a dividing line between opposing indicia adjacent the edges of the adjoining revolutions. For example, by reference to FIG. 8, it may be seen that the indicia $A_1$ and $A_2$ extend from seam 41 between the revolution 42 and revolution 43. The broken lines 45 represent the interlocking edges of the adjoining revolutions. The indicia $B_1$ extends from the seam 41 on the revolution 43. Assuming the pipe being wound is of the proper diameter, the distance between successive indicia such as that shown in FIG. 8 as the distance 48 should remain constant. If the distance 48 begins to change, either by increasing or decreasing, then it is an immediate indication to the operator that the diameter of the pipe is changing.

Figure 8:
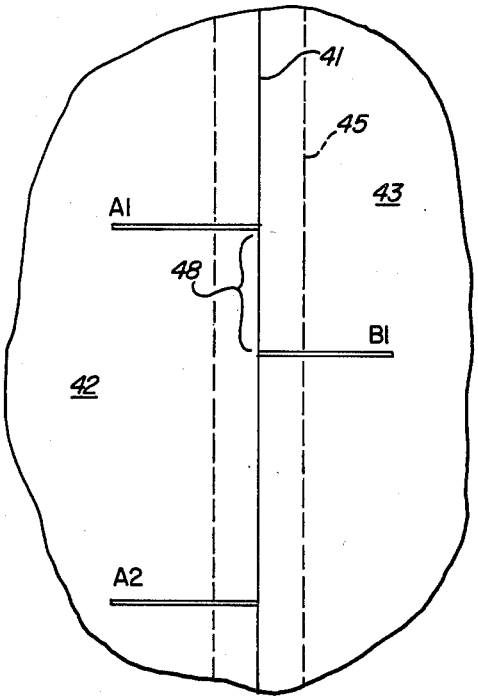
FIGS. 8 and 9 are illustrations of abutting or adjoining edges of adjacent revolutions of a helically wound pipe showing the opposing indicia placed in accordance with the teachings of the present invention.
Figure 9:
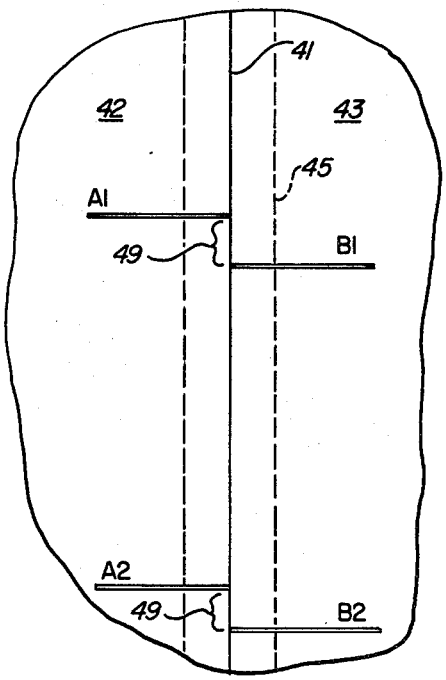

If the change in the distance 48 proceeds to the extent of that shown in FIG. 9 as the distance 49, the operator knows that the diameter of the pipe has been changed by an amount equal to the difference of the distances 48 and 49 divided by pi. That is, the indicia on the pipe are spaced relative to the diameter of the pipe by a function of $1/\pi$. If, for example, the pipe in FIGS. 8 and 9 is being formed such that the revolution 43 is the newer revolution of the pipe, the difference between the distances 48 and 49 indicates to the operator that the diameter of the pipe has decreased. Therefore, by observing the indicia, and the distances between opposing indicia extending from the joint between adjoining revolutions, the operator can readily observe changes in the diameter of the pipe as the changes occur. The distance 48 between the indicia $A_1$ and $B_1$ is the same distance between all opposing indicia (i.e., $A_2$, $B_2$; $A_3$, $B_3$; etc.) so long as the diameter of the pipe remains the same. As the diameter begins changing, the distance 48 will increase or decrease; the trend in the change of the diameter of the pipe is amplified by the fact that any diameter change is multiplied by the factor of pi and represented by the increase or decrease in the distance between opposing indicia. Therefore, because any change in diameter is multiplied approximately three times, it becomes quite easy for the operator to detect even slight changes; the early detection not only gives better and more accurate information needed for immediate remedial reaction for control, but saves the down time required to measure the pipe. Further, since such measurements are no longer required, the danger to the workman having to climb onto the forming equipment to make the measurement is thereby eliminated.

The distances between successive indicia on the strip is not particularly important so long as the spacing is uniform. Further, the indicia may be formed of any kind of marks or series of marks, or short straight lines extending from the edge of the strip from which the pipe is formed, or may be lines extending across the width of the strip.

I claim:

1. In a method of forming a helically wound pipe of a predetermined diameter from an elongated sheet having a longitudinal axis and having a pair of opposing edges extending parallel to said longitudinal axis, the improvement comprising: marking said elongated sheet adjacent said opposing edges thereof with indicia at predetermined spaced intervals, said indicia so marked extending perpendicular to said longitudinal axis; feeding said elongated sheet in a direction parallel to its axis; helically winding said elongated sheet to form a helically wound pipe having adjoining revolutions, and during said winding maintaining the diameter of said helically wound pipe equal to said predetermined diameter by maintaining a predetermined distance, parallel to said longitudinal axis, between indicia adjacent the edge of one revolution and the indicia adjacent the edge of an adjoining revolution.

2. The method of claim 1 wherein said indicia is formed of straight lines extending perpendicular to said longitudinal axis from each edge of said sheet toward the center thereof.

3. The method of claim 2 wherein said indicia comprises equally spaced stripes extending from one side edge of said sheet to the other side edge of said sheet in a direction perpendicular to said longitudinal axis.

4. The method of claim 1 further comprising the step of forming corrugations within said elongated sheet, said corrugations extending parallel to said longitudinal axis.

5. The method of claim 1 wherein said predetermined diameter of said helically wound pipe may be selected irregardless of the predetermined interval between said indicia.

6. The method of claim 1 wherein said step of helically winding said elongated sheet is performed with a winding machine having an adjustment for varying the diameter of pipe wound thereby, and wherein said step of maintaining a predetermined distance between indicia adjacent the edge of one revolution and the indicia adjacent the edge of the adjoining revolution comprises the steps of:

a. continuously observing the distance, parallel to said longitudinal axis, between indicia adjacent the edges of adjoining revolutions of said helically wound pipe as said adjoining revolutions are wound by said winding machine;

b. comparing said continuously observed distance to said predetermined distance to detect variations therefrom; and c. adjusting said winding machine whenever a variation from said predetermined distance is detected until said continuously observed distance is again equal to said predetermined distance in order to compensate for variations in the diameter of said helically wound pipe from said predetermined diameter.

* * * * *

REEXAMINATION CERTIFICATE (199th)

United States Patent [19] [11] B1 4,287,739

Campbell [45] Certificate Issued May 22, 1984

[54] METHOD FOR PRODUCING A HELICALLY WOUND PIPE HAVING A PREDETERMINED DIAMETER

[75] Inventor: George L. Campbell, Scottsdale, Ariz.

[73] Assignee: Syracuse Tank & Manufacturing, Phoenix, Ariz.

Reexamination Request:
No. 90/000,417, Jul. 11, 1983

Reexamination Certificate for:

| | |
|---|---|
| Patent No.: | **4,287,739** |
| Issued: | **Sep. 8, 1981** |
| Appl. No.: | **23,585** |
| Filed: | **Mar. 26, 1979** |

[51] Int. Cl.[3] ..... B21C 51/00; B21C 37/12
[52] U.S. Cl. ..... 72/34; 29/407; 72/50; 228/56.5
[58] Field of Search ..... 29/33 D, 407, 429, 509; 72/34, 49, 50, 135; 138/154; 228/13, 17.7, 56.5, 145, 147, 151

[56] References Cited

U.S. PATENT DOCUMENTS

| | | | |
|---|---|---|---|
| 2,301,092 | 11/1942 | Thompson et al. | 101/228 |
| 2,515,365 | 7/1950 | Zublin | 138/154 X |
| 3,140,534 | 7/1964 | Messina | 29/407 |
| 3,217,402 | 11/1965 | Eckhardt | 228/13 X |
| 3,417,587 | 12/1968 | Campbell | 72/50 |
| 3,739,459 | 6/1973 | Otani | 228/145 |

FOREIGN PATENT DOCUMENTS

| | | | |
|---|---|---|---|
| 258520 | 4/1928 | Italy | 138/154 |

*Primary Examiner*—Ervin M. Combs
*Attorney, Agent, or Firm*—Cahill, Sutton & Thomas

[57] ABSTRACT

A method for forming helically wound pipe from an elongated sheet of material having a longitudinal axis wherein markings are provided perpendicular to said longitudinal axis adjacent the edges of the elongated sheet of material at predetermined spaced intervals. The elongated sheet is fed in a direction parallel to its axis and wound helically to form a helically wound pipe having adjoining revolutions while maintaining the distance, parallel to said longitudinal axis, between successive indicia adjacent the edge of one revolution and the indicia adjacent the edge of the adjoining revolution constant.

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–6, having been finally determined to be unpatentable, are cancelled.

New claims 7–12 are added and determined to be patentable.

*7. A method of producing helically wound pipe of different diameters comprising the steps of selecting an elongated sheet having a longitudinal axis and a pair of edges extending parallel to said axis, marking said sheet adjacent each of its edges with indicia extending perpendicular to said axis, the spacing of said indicia along one edge of said sheet being uniform and the spacing of said indicia along the other edge of said sheet being uniform and equal to the spacing of the indicia along said one edge of the sheet, the positioning of indicia along said one edge in relation to the positioning of said indicia along the other edge being arbitrarily selected without regard to the diameter of pipe to be wound from said sheet, thereafter winding pipe of selected diameter from the sheet thus marked by feeding said sheet longitudinally into a pipe winding machine having means for varying the diameter of the pipe being wound, causing said machine to wind said sheet into a helically wound pipe having adjoining revolutions in such a manner that the indicia appearing along the edge of one revolution do not match up with the indicia appearing along the edge of an adjoining revolution, observing the displacement measured parallel to said longitudinal axis of indicia appearing along adjoining edges of adjoining revolutions and manipulating said diameter varying means while said machine is winding pipe to maintain a predetermined such displacement and thereby control the diameter of the pipe during winding.*

*8. The method of claim 7 including the step of marking said elongated sheet with indicia which extends across the width of the sheet from one edge thereof to the other edge thereof.*

*9. The method of claim 7 including the step of marking said sheet with a plurality of equally spaced parallel indicia stripes extending from one edge of the sheet to the other edge of the sheet.*

*10. The method of claim 7 further including the steps of winding said marked sheet into a roll, transporting the marked roll of sheet to said pipe winding machine and unwinding the marked roll.*

*11. The method of claim 8 further including the steps of winding said marked sheet into a roll, transporting the marked roll of sheet to said pipe winding machine and unwinding the marked roll.*

*12. The method of claim 9 further including the steps of winding said marked sheet into a roll, transporting the marked roll of sheet to said pipe winding machine and unwinding the marked roll.*

* * * * *